United States Patent [19]

Hancox et al.

[11] Patent Number: 4,830,617

[45] Date of Patent: May 16, 1989

[54] APPARATUS FOR SIMULATED SHOOTING

[75] Inventors: Roger J. Hancox, Burntwood; Cecil H. Banks, Streetly, both of England

[73] Assignee: Accles and Shelvoke Limited, Birmingham, England

[21] Appl. No.: 98,288

[22] Filed: Sep. 18, 1987

[51] Int. Cl.[4] ..... F41G 3/26

[52] U.S. Cl. ..... 434/21; 42/103; 273/311; 362/111

[58] Field of Search ..... 434/21, 22, 20; 42/103; 273/310, 311, 312; 362/110, 111, 112; 200/62, 159 B

[56] References Cited

U.S. PATENT DOCUMENTS

| | | | |
|---|---|---|---|
| 2,826,677 | 3/1958 | Jobanek | 434/21 |
| 3,240,924 | 3/1966 | Darby | 434/21 |
| 3,471,945 | 10/1969 | Fleury | 434/21 |
| 3,510,965 | 5/1970 | Rhea | 434/21 |
| 3,526,972 | 9/1970 | Sumpf | 434/21 |
| 4,048,489 | 9/1977 | Giannetti | 362/111 |
| 4,234,911 | 11/1980 | Faith | 362/111 |
| 4,367,516 | 1/1983 | Jacob | 362/111 |
| 4,481,561 | 11/1984 | Lanning | 362/111 |
| 4,488,369 | 12/1984 | Note | 362/110 |
| 4,678,437 | 7/1987 | Scott et al. | 434/21 |

FOREIGN PATENT DOCUMENTS

| | | |
|---|---|---|
| 1034026 | 6/1966 | United Kingdom . |
| 1595189 | 8/1981 | United Kingdom . |

*Primary Examiner*—James C. Yeung

*Attorney, Agent, or Firm*—Leydig, Voit & Mayer

[57] ABSTRACT

Apparatus for the simulated shooting of small arms comprises a miniaturized electrical energy source for a radiation emitter which is capable of being accommodated within a dummy cartridge or within the gun barrel. The source can be a capacitor slidably located within the dummy cartridge and which co-operates with a barrel unit housing a switch section, an electronics section, and a pulsed infra-red emitter. On firing the gun the capacitor is propelled forwards by the firing pin of the gun until a probe-like switch portion on the capacitor contacts a corresponding switch portion on the barrel unit so actuating the emitter to give a series of timed pulses which pass through a lens system.

13 Claims, 6 Drawing Sheets

APPARATUS FOR SIMULATED SHOOTING

TECHNICAL FIELD

This invention relates to apparatus for simulated shooting particularly, but not exclusively, to apparatus which is adapted to be used with conventional small arms to convert a gun such that on firing the gun a beam of electromagnetic radiation is emitted which can be detected by a suitable target sensor, and which thereby enables firing practice without live ammunition but with an actual gun. Apparatus of this kind will hereinafter be referred to as apparatus of the kind defined.

One advantage of using an actual gun is that a person can practise at minimal expense and without danger, use of a gun which he might only rarely be called upon to use with live ammunition in a crisis situation.

Another use of the invention is to practise gun sports in a confined area.

BACKGROUND ART

Apparatus of the kind defined is known from G.B. Patent Specification Nos. 1 034 026 and 1 595 189.

G.B. Specification No. 1 034 026 describes a dummy cartridge housed in a cartridge chamber which acts as a switch when a slidable contact member thereof is struck by the firing pin and moves outwardly of the chamber to contact a barrel accessory comprising a radiant energy emitter. In this earlier arrangement the electrical power source is external of the firearm which not only detracts from realistic simulated use of the firearm but adds the complication of electrical conductors between the source and the firearm. G.B. Specification No. 1 595 189 describes a conventional pistol which is adapted for simulated shooting by inserting a radiant energy emitter and switch unit in the barrel and providing an electrical source in the pistol magazine. In this arrangement, not only does the magazine have to be provided with an electrical conductor but the realism of inserting a cartridge into the cartridge chamber is lost. Hitherto there appears to have been a problem in providing a power source for the radiation emitter which was small enough to enable ready adaption of a small arm for realistic simulated shooting without any modifications to the small arm being necessary.

DISCLOSURE OF INVENTION

According to one aspect of the present invention we provide apparatus adapted to be housed within a small arm, the apparatus comprising an emitter of electromagnetic radiation adapted to provide an emission of radiation from the barrel of the gun, and an electrical energy source for the emitter comprising a capacitor, the arrangement being such that the emitter is operated on firing of the small arm.

Thus, instead of a battery provided externally of the gun or in the gun butt or magazine as in the case of the above-mentioned prior art, a suitable capacitor is accommodated within the gun, and the capacitor can be charged up, preferably before it is inserted into the gun, and conveniently from a suitable portable rechargeable battery pack.

Low loss electrolytic capacitors are found to hold a charge for several hours without significant loss and are therefore suitable for this purpose, but other suitable types of capacitor may be employed. The capacitor may with advantage be housed within a dummy cartridge which can be loaded into the gun, be it a pistol, rifle, or shot gun, in conventional manner, and will therefore assist in simulating normal use of the gun. The term "cartridge" is intended to include bullets, shells and the like.

When the dummy cartridge has been 'fired' it can be recharged very quickly by inserting into a suitable socket in a portable battery pack.

Thus, we provide dummy cartridges for a revolver, automatic pistol, rifle, shot gun, or other similar small arm, which can be loaded into the magazine or cartridge chamber in the usual way and unloaded after firing. Similarly, for those small arms having cartridge ejectors the ejected cartridges can be collected for recharging.

Although it might be possible to incorporate the radiation emitter and associated circuitry all within a dummy cartridge, we prefer to arrange the emitter in a barrel unit which is adapted to fit within the barrel of the gun, means being provided for electrically connecting the capacitor of a dummy cartridge located in the gun in a firing position to the barrel unit for energising the radiation emitter.

Preferably the nose of the dummy cartridge houses a spring biassed electrical contact, such as a pin, which can be projected to make electrical connection with a suitable electrical contact on or in the rear end of the barrel unit, and it is preferably arranged that the spring biassed contact is projected by the action of the gun's firing pin.

The expression "firing pin" is intended to embrace any type of moveable bolt, striker, hammer and the like capable of actuating the dummy cartridge.

In one preferred arrangement the dummy cartridge comprises tubular, co-axial, contacts which extend through a bore in the nose of the cartridge on "firing" to make sliding contact with corresponding contacts of the barrel unit. The cartridge contacts are retained in their normal rearward position within the cartridge casing by a compression spring and the "make and break" time of the emitter switch can be adjusted by the rate of the spring selected.

Although the capacitor may be fixed in position in the cartridge casing it is preferably movably mounted within the cartridge casing, one end of the capacitor carrying a positive or negative cartridge contact or both positive and negative contacts where they are co-axial or mounted side-by-side, and its other end co-operating with a firing-pin engageable member.

An advantage of arranging the radiation emitter and associated energising circuitry in a barrel unit instead of in the cartridge itself, is that these components will not receive the mechanical handling to which the cartridges are subjected, and there will consequently be less chance of damage to these components.

A pulsed radiation emitter is desirable to enable the target sensor to distinguish between radiation emitted by the gun and ambient radiation.

A relaxation oscillator powered by the charged capacitor is preferably employed to operate the radiation emitter. The oscillator preferably comprises a unijunction transistor of which the emitter voltage is determined by a further capacitor which is connected between the emitter electrode and one of the supply lines from the power supply capacitor, at least when the power supply capacitor is connected to the relaxation oscillator to initiate pulsing, and the output from the oscillator circuit is preferably taken from the second base B2 electrode, as compared with the usual practice which is to take the output from the first base B1 electrode of the unijunction transistor.

The output from the oscillator circuit is preferably connected to a pair of small transistors arranged in parallel to drive the radiation emitter, which may be an infra-red emitting diode, or a laser diode.

A second aspect of the invention is concerned with an arrangement for transmitting a firing signal between a dummy cartridge which is operated by the firing pin of a small arm, and a barrel unit which is adapted to fit within the barrel of the small arm and which incorporates a power source and radiation emitter for emitting radiation from the barrel of the gun.

According to the second aspect of the invention apparatus adapted to be housed within a small arm to produce a beam of electromagnetic radiation on 'firing' of the small arm comprises a dummy cartridge adapted to be received within the cartridge chamber of the small arm, and a barrel unit adapted to be received within the barrel, the barrel unit comprising a radiation emitter, an electrical energy source, and switch means for connecting the energy source to the radiation emitter, the dummy cartridge being adapted to relay a firing signal from the firing pin of the gun to the switch means, which is adapted to be operated by the signal from the dummy cartridge.

The power source in the barrel unit will in this case usually be a rechargeable battery, and this aspect of the invention will therefore be more applicable to larger small arms, since special small batteries would be required for hand guns.

Various arrangements may be employed for relaying the firing signal to the switch means by way of the dummy cartridge. In one preferred arrangement the dummy cartridge incorporates a piezo-electric crystal arranged to provide a high voltage electrical pulse when the rear end of the cartridge is struck by the firing pin.

The electrical pulse is preferably then applied to the switch means by a capacitative connection between the front of the dummy cartridge and the rear of the barrel unit, the capacitative connection permitting a clearance space between the front of the dummy cartridge and the rear of the barrel unit, which is particularly desirable in a revolver or automatic pistol.

The capacitative connection may comprise a plate on the rear end of the barrel unit confronting a similar plate or a pin on the front of the cartridge.

Alternatively, the piezo-electric crystal could power a further radiation emitting device in the dummy cartridge, a suitable radiation detector being provided in the barrel unit to detect radiation falling on the rear end of the barrel unit, the detector being arranged to operate the switch means.

Since a piezo-electric crystal is relatively robust such a dummy cartridge can be made to withstand repetitive loading and unloading/ejection.

Although the preferred radiation source is an infra-red light emitting diode such emitters produce a diverging beam of radiation which would have too large a cross-sectional area (disc area) at the plane of the target relative to the calibre of the gun and range of the target. Consequently, optical means are provided which may be carried on the end of the emitter or located within the barrel unit, to reduce the divergence and adjust the size of the disc area to match the calibre of the gun and the scaled down range of the target. Such optical means may comprise a lens or a combination of lenses and reflective surfaces. However, when using small arms, other than shot guns, which in practice will generally be aimed at a fixed or slowly moving target at a greater distance it is desirable to make the infra-red light beam as nearly parallel as possible.

According to a third aspect of the invention we provide apparatus adapted to be housed within a small arm, the assembly comprising an emitter of electromagnetic radiation adapted to provide an emission of radiation from the barrel of the gun, and an electrical energy source for the emitter comprising a capacitor, in which the emitter is a laser diode.

Preferably the laser diode is adapted to produce a substantially parallel beam of pulsed emissions.

A fourth aspect of the invention is particularly, but not exclusively, applicable to shot guns.

According to the fourth aspect of our invention a self-contained cartridge assembly adapted to be housed within the barrel of a conventional gun comprises a battery portion which is axially positioned between a radiation emitting portion and a switch portion, the switch portion being adapted to be operated by the normal firing mechanism of the gun, and the arrangement being such that on firing of the gun the switch portion is operated to cause a pulse of radiation to be emitted by the radiation portion, the battery portion providing the power source for the radiation emitting portion.

The switch portion may comprise a piezo-electric crystal actuated by the firing pin and is preferably combined with the battery portion and an electronics portion as a single unit, the assembly being completed by a second unit containing the radiation emitter which is electrically connectable to the first unit.

The battery portion conveniently comprises a stack of Ni—Cd batteries located in a holder, such as a plastics sleeve.

The battery portion preferably incorporates a fuse. The two units of the cartridge assembly are preferably connected to one another by a plug and socket connection to enable the battery portion to be recharged, and also to enable a portion to be quickly replaced in the event of failure.

Since Ni—Cd batteries can provide a high discharge current when connected in series it is preferred that the plug and socket connection is only made just prior to use.

The invention will now be further described, by way of example only, with reference to the accompanying drawings.

BEST MODE FOR CARRYING OUT THE INVENTION

Figure 1:
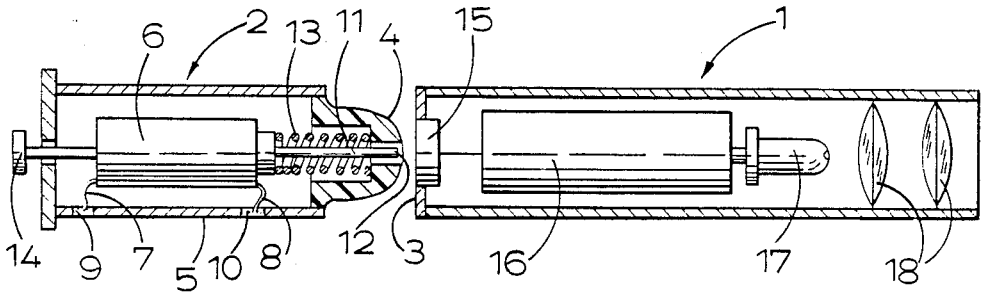
FIG. 1 is a diagrammatic longitudinal section of a dummy cartridge and barrel unit of a first embodiment of the invention.

With reference to FIG. 1, this shows apparatus for housing within a small arm to convert the gun for emitting infra-red radiation on operation of the gun's firing mechanism. The apparatus comprises a barrel unit 1 and at least one dummy cartridge 2, the barrel unit 1 being dimensioned to fit within the gun barrel and being provided with suitable location means, not shown, for holding the unit 1 such that its rear end 3 is closely spaced from the front end 4 of the cartridge 2 when the cartridge is in position in a cartridge chamber of the gun which is in axial alignment with the barrel. The gun could be a revolver or automatic pistol and in both of those cases in order to simulate multiple firings of the gun it would be necessary to have several of the dummy cartridges 2.

The dummy cartridge 2 comprises a casing 5 in which is axially slidably mounted, by guides not shown, a low leakage electrolytic capacitor 6 which may have suitable electrical connections 7, 8, such as sliding connections or flexible wires, at its opposite ends with external contacts 9, 10, on the casing 5 to enable the capacitor 6 to be charged before the dummy cartridge 2 is loaded into the gun. Alternatively, a charging connection to the front end of the capacitor can be made by way of a contact pin 11 which is carried by the front end of the capacitor. The axial contact pin 11 has its front end 12 positioned a few thousandths of an inch within the extremity of the front end 4 when the capacitor is in its normal rearward position to which it is biassed by a suitable compression spring 13. The rear end of the capacitor carries a suitable plunger 14 which is engageable by the gun's firing pin to propel the capacitor 6 and contact pin 11 forwards on operation of the gun's firing mechanism.

It will be preferable to connect the −ve end of the capacitor to the metal dummy cartridge case 5, and the +ve end to the contact pin 11 which moves through the nose 4 of the cartridge which is made of suitable insulating material.

The charging unit (not shown) for the cartridges will have as many sockets as necessary, each socket having contacts which connect to the outer case 5 of the cartridge and a spring contact which may be situated at the bottom of the socket for making contact with the centre pin of the cartridge when the cartridge is inserted into the socket. A small LED is connected in series with each socket centre pin which will be illuminated when a cartridge is inserted and extinguishes when the capacitor is fully charged prior to being loaded into the gun.

Figure 4:
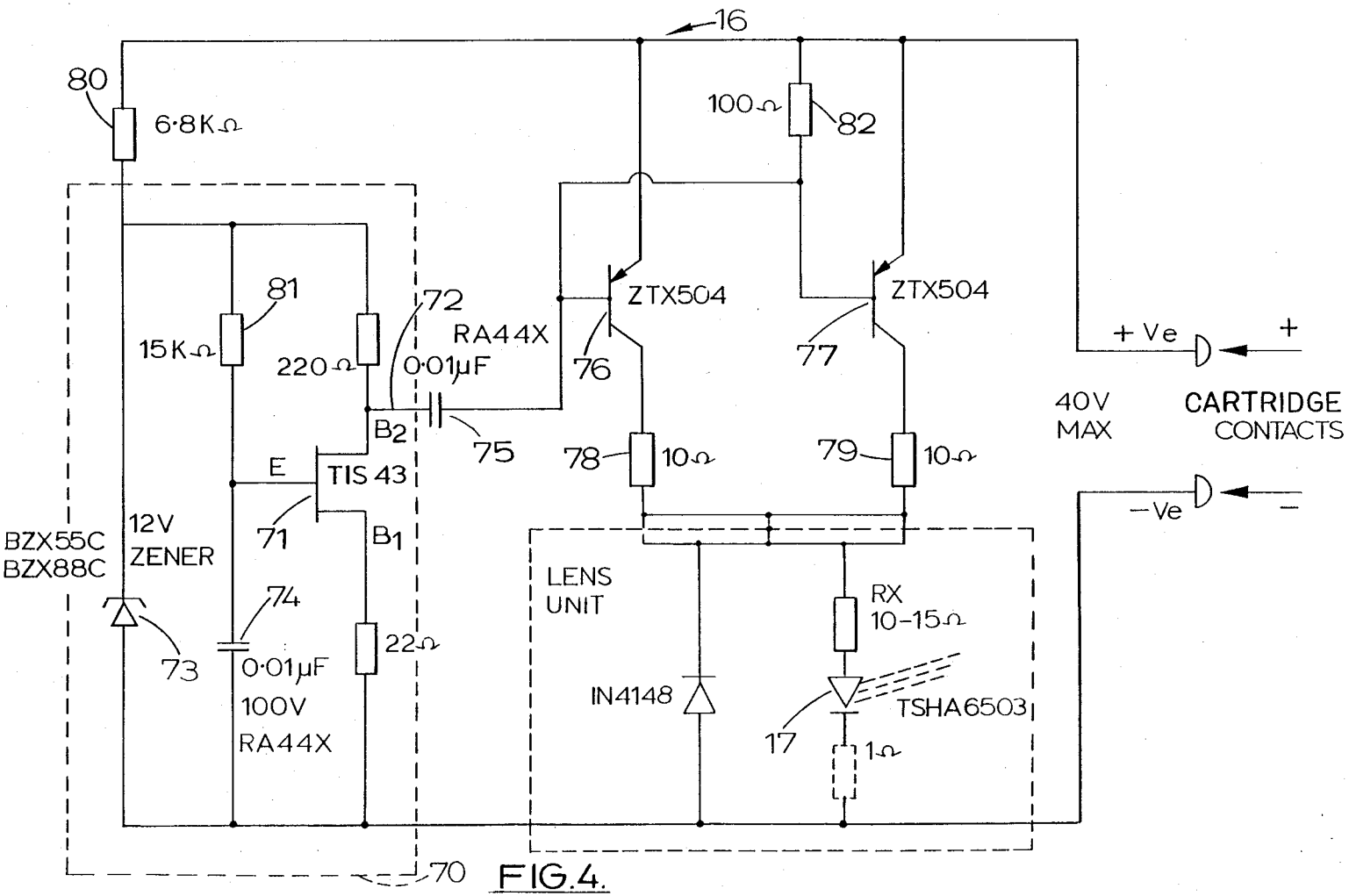
FIG. 4 is a circuit diagram of the pulse circuit of the barrel unit of the embodiments of FIGS. 1 and 3.

The rear end 3 of the barrel unit 1 carries a contact plate 15 for engagement by the projected contact pin 11 and which is electrically connected to an energisation circuit 16, the circuit of FIG. 4, which is arranged to produce repetitive pulsing of an infra red diode 17 when the contact plate 15 is electrically connected to capacitor 6 through contact pin 11 and plate 15.

The barrel unit 1 at its front end may house a suitable lens assembly 18 for controlling the spread of the infra-red radiation emitted by the diode 17. This is further controlled by coating the diode with a sputtered aluminium reflecting layer apart from a 1.5 mm diameter area at the front of the diode through which the radiation issues. Alternatively, a separate metal mask may be used which will be described in more detail below in connection with FIG. 10.

The capacitor 6 in the case of a 0.32" cartridge can be two 22 μF 25 v capacitors electrically connected in series, physically arranged in tandem, the combination of capacitors being charged to 40 volts prior to loading into the gun. The net capacitance of the two 22 μF capacitors is 11 μF, and the advantage for this calibre of using this combination of capacitors instead of a single 10 μF capacitor is that 22 μF capacitors are available in a smaller diameter than 10 μF capacitors.

For larger cartridges a single 100 μF 40 v capacitor may for example be accommodated.

A principal benefit of using a voltage as high as 40 volts is that the stored energy of the capacitor is relatively large, bearing in mind that the stored energy is proportional to the square of the voltage for a given capacitance. The choice of capacitance and charging voltage will depend upon how many pulses of infra-red radiation are required to be produced, and whether the user is to be forced to re-charge the capacitor after a single firing, to simulate more closely the requirements of real shooting.

Figure 2:
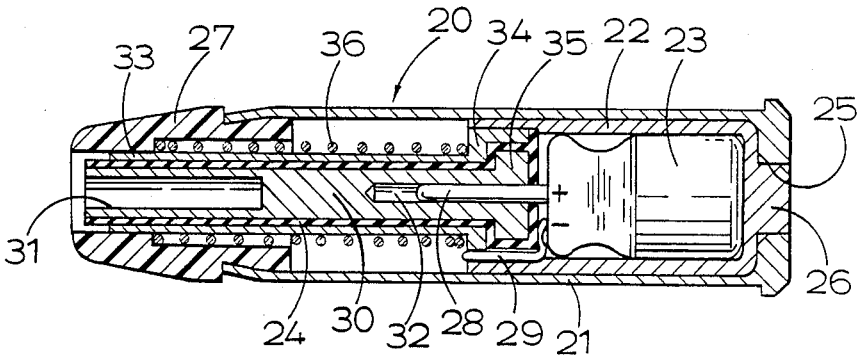
FIG. 2 is a longitudinal cross-section of a dummy cartridge which is a modification of the cartridge of FIG. 1.
Figure 3:
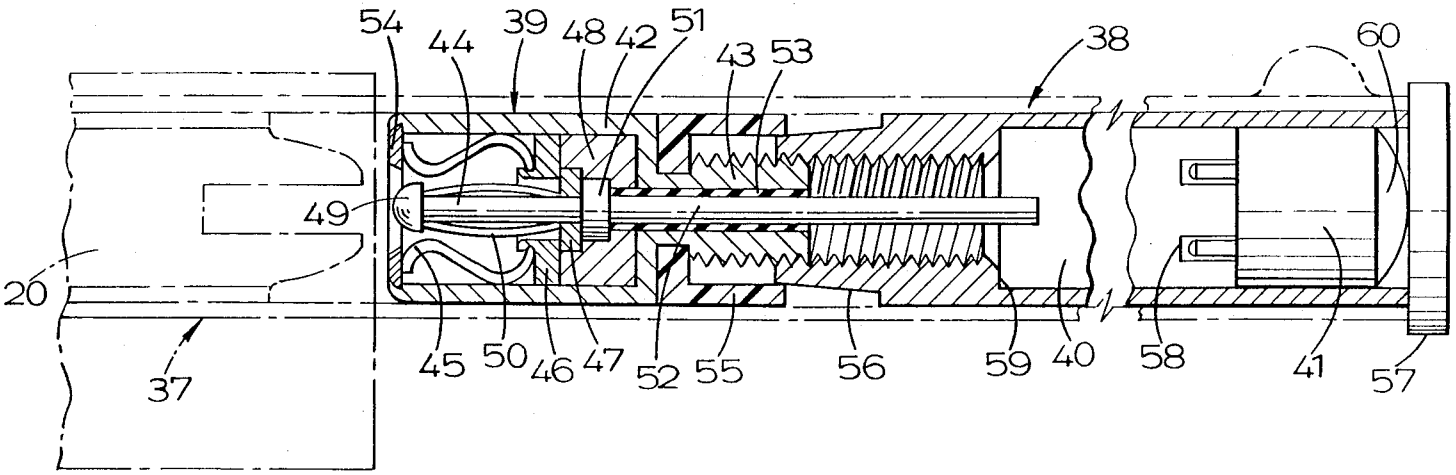
FIG. 3 is a longitudinal cross-section of a barrel unit including a radiation emitter and switch element for operative co-operation with the cartridge of FIG. 2.

A modified form of dummy cartridge and barrel unit primarily intended for a pistol or revolver is shown in FIGS. 2 and 3 respectively and is a generally similar arrangement to that shown in FIG. 1 but differs in that the switch elements engage in a sliding action when the gun is "fired". This arrangement not only provides for a more positive contact between the switch elements, they are also self-cleaning and permit better control of the time in which they are in contact. The contact time can advantageously be used to determine the number of radiation pulses emitted by the emitter.

FIG. 2 shows a dummy cartridge 20 comprising an outer case 21 the shape and physical dimensions of which are substantially the same as those of the appropriate real cartridge for the specific small arm which, in this example, is the 0.357" Magnum (trade mark) pistol. The outer case 21 contains an inner case 22 consisting of a cylindrical housing which is an easy sliding fit within the outer case and is approximately half its length. The inner and outer cases 21, 22 are both made of brass but may be of any other suitable material as it is not essential for these casings to be electrical conductors. The base of the outer case 21 has a through-bore 25 centrally positioned which receives a cylindrical nose portion 26 extending from the base of the inner case 22 and which serves as the "percussion cap" or striker pad for the firing pin of the pistol. The front end of the outer casing is slightly tapered for the purpose of locating a removable plastics nose cone 27. The inner case 22 contains a low leakage electrolytic, radial lead capacitor 23 as the power source for the emitter which normally operates at 20 volts. The capacitor is suitably of 10 μF 63 v. A central thin rod electrode 28 extends forwardly from the capacitor 23 parallel with an adjacent bent wire electrode 29 which serve, respectively, as the positive and negative connections from the capacitor. An inner, generally tubular, brass, probe contact 30 has co-axial blind bores at its opposite ends extending inwardly for a major portion of the contact axis The forward end bore 31 which has a greater diameter than the rearward bore 32, receives, in operation, the positive connection of a barrel unit, yet to be described, and the rearward end bore 32 receives the thin rod electrode 28. The probe contact 30 carries an outer tubular probe contact 33 which is a slide fit on the inner contact 30. It is slightly shorter than the inner contact for a reason yet to be explained and has a cup-like headed portion 34 which is push fit into the forward end of the inner case 22 where it abuts a cylindrical flange adjacent to the mouth of the inner case. The inner contact 30 has a cylindrical flanged portion 35 at its inner end which is received in the cup-like headed portion 34 of the outer contact 33. The two contacts 30, 33 are electrically insulated one from the other by a nylon sleeve 24 which extends in tightly fitting manner over the whole length of the inner contact 30 including the flanged end portion. An axially extending slot in the headed portion 34 of the outer contact 33 provides a passage and contact point for the negative electrode 29. As stated above the headed portion 34 of the outer electrode 33 is a push fit in the end of the inner case 22, hence the capacitor 23 and the inner and outer contacts 30, 33 are firmly but detachably held in the inner case 23. Between the front annular face of the outer contact 33 and the rear face of the nose cone 27 there is an annular space allowing for axial forward movement of inner case 22 together with the capacitor 23 carrying the inner and outer contacts 30, 33. The nose cone 27 has an axial through bore which is counterbored from the rear face to provide an annular abutment for a light extension spring 36 which extends between the annular abutment and the annular front face of outer contact 33. The capacitor housing and the contact assembly are thus normally held by the spring 36 against the base of the outer case 21 with the nose portion 26 occupying the bore 25. The front end of the contact assembly extends through the bore of the nose cone 27 and the arrangement is such that the free ends of both the inner and outer contacts 30, 33 are normally positioned just inside the mouth of the nose cone 27 with the inner contact 30 leading the outer 33. This arrangement is designed to prevent any "bridging" of the contacts by foreign matter. The spring 36 ensures that the capacitor/contact assembly is held in the rearward position whilst being inserted into the cartridge chamber or magazine and the rate of the spring is specially selected to give the optimum contact time with the switch portion of the barrel unit on "firing" the pistol. When the pistol is "fired" the firing pin strikes the nose 26 and the capacitor electrode assembly is propelled forwards rapidly against the force of the spring 36 so that the contacts momentarily protrude from the nose cone 27 a short distance and contact corresponding switch members of the barrel unit. The spring 36 will be substantially fully compressed before returning the capacitor/electrode assembly to its rearward position.

In a slightly modified form, for convenience of manufacture, the plastics insulator 24 may comprise two parts, a tubular sleeve, and a slotted washer which abuts the front end of the capacitor. It is however important that the sleeve is a force fit over the centre electrode to prevent any possible ingress of moisture.

With reference to FIG. 3 there is shown the ghosted outline of a pistol barrel and a cartridge chamber 37 containing a dummy cartridge 20 as just described. The barrel unit 38 comprises a switch section 39, an electronics section 40, alternative circuits of which will be described below, and an IR-LED emitter 41. It will be appreciated that in order to achieve simulated "firing" of the dummy cartridge 20, the cartridge chamber 37 and the barrel unit 38 are essentially in axial alignment and in most designs of small arm there must be a small gap between the breech block, or cylinder in the case of a revolver, and the end of the barrel which will have to be "bridged" by the contacts 30 and 33 of the dummy cartridge.

The switch section 39 of the barrel unit comprises an open ended cylindrical housing 42 which is a slide fit in the bore of the pistol barrel and a forwardly extending screw threaded neck portion 43 of reduced diameter which joins the housing 42 to the electronics section 40. The housing 42 contains positive and negative switch contacts referenced 44 and 45 respectively. The negative contacts comprise a pair of spring elements which extend in a double curvature from the base of an annular spring holder 46 which has a terminal connection (not shown) with the electronics section 40 but is electrically insulated from the positive contact 44 by an insulating washer 47 recessed in the front face of a positive contact holder 48 which is also insulated from the housing 42. The positive contact 44 is formed as an elongate pin having a mushroom shaped head 49 and a plurality of curved spring contacts 50 extending between the head 49 and an intermediate shouldered portion 51 which locates the contact in the holder 48 by abutting the rear face of the insulating washer 47. A tail portion 52 of the positive contact 44 extends forwardly i.e. towards the muzzle of the gun to make contact in the electronics section 40 but that part of the tail portion which is within the neck portion 43 is insulated therefrom by a tightly fitting plastics sleeve 53. The positive and negative contacts are retained in the housing 42 by a circlip 54 located in the rear end of the housing. Surrounding the screw-threaded neck portion 43 of the housing 42 there is provided a split, expandable, plastics washer 55 which has forwardly extending flange portions dimensioned to receive a tapered end portion 56 of the barrel unit 38. A screw-threaded internal bore of the barrel unit mates with the externally threaded end of the neck portion 43 and it will be seen that by screwing a knurled head 57 on the front end of barrel unit 38 the washer 55 may be expanded and when the unit is inserted in the barrel of a pistol such expansion will serve to releasably lock the barrel unit 38 tightly in the barrel of the pistol as the expanded washer presses against the sides of the barrel. Alternatively, a suitable 'O' ring may be used.

The electronics section 40 and light emitting diode 41 (LED) are releasably joined by a plug and socket type connection 58 and located as an assembly against an internal shoulder 59 of the barrel unit housing which is of an electrically conductive metal and forms the negative contact of the electronics section. A lens 60 may be provided on the front of the LED 41.

The barrel unit is dimensioned for use in a particular small arm, in this case a pistol, and when located in the barrel thereof as described above together with a charged dummy cartridge 20 in the cartridge chamber is ready for use. On pulling the trigger of the pistol the positive 30 and negative 33 co-axial contacts of the bullet will be propelled as one unit by the firing pin across the small gap between the cartridge chamber and the barrel unit and the inner positive contact 30 will slide over the head 49 and make rubbing contact with the curved springs 50. Similarly the outer negative contact 33 will slide against the inner faces of curved springs 45 so completing a capacitor circuit between the cartridge 20 and the barrel unit 38 for a one shot emission of infra-red radiation from the pistol.

Alternative energisation circuits will now be described with reference to FIGS. 4 and 5.

In the circuit of FIG. 4, which is applicable to the embodiment described with reference to FIGS. 1, 2 and 3, the capacitor 6 23, will be connected between the +ve and −ve terminals when the contact pin 11, 30, 33, is projected by the firing pin into contact with the plate 15 (FIG. 1) or contacts 44, 45 (FIG. 3).

The oscillator circuit 70 is essentially a relaxation sscillator circuit employing a unijunction transistor 71, a TTb 1S43 (manufacturer not known but marked RS, and equivalent to GE 2N2646 of General Electric of America), but the output lead 72 is taken from the B2 base electrode of the unijunction transistor 71 rather than from the B1 base electrode as is usual. The supply of the oscillator is controlled at 12 V by a second zener diode 73.

The emitter E voltage of the transistor 71 is controlled by a 0.01 μF capacitor 74 the charging and discharging of which gives rise to the switching of the transistor which produces the output pulses on line 72.

The output from the oscillator 70 on line 72 is taken by way of a coupling capacitor 75 to a pair of transistors ZTX504 (Ferranti) referenced 76, 77 arranged in parallel. The output pulses from the transistors 76, 77 supply the infra-red emitting diode 17,41 via resistor RX and resistors 78 and 79 which are effectively in parallel.

The IR-LED 17, 41 (FIGS. 1 and 3) is a TSHA6503 of Telefunken but a T1L38 could be used.

A benefit of using a capacitor voltage as high as 40 volts is that since the duration of the pulses fed to the IR-LED 17, 41 are dependent upon the width of the pulses fed from the oscillator 70, the peak amplitude of the IR-LED pulses is primarily dependent on the series resistance in the output circuit.

In the circuit shown are two 10 ohm resistors 78 and 79, one in each emitter lead of the two parallel transistors 76, 77 being equivalent to 5 ohms in the output circuit and a resistor RX of nominally 10 to 15 ohms in the cathode lead of the IR-LED. RX is conveniently adjusted to provide a peak pulse current of 1250 mA to the IR-LED 17 when the input voltage provided by the capacitor is 40 volts. The particular circuit shown has the characteristic that the IR-LED pulse current will fall to approximately 1000 mA when the capacitor voltage has fallen to 25 volts, and to approximately 800 mA when the capacitor voltage has fallen to 20 volts, the voltage falling exponentially. The capacitor is initially charged to 40 volts. Since the amplitude of the pulses applied to the IR-LED falls rapidly there is no need to provide a timing device for controlling the overall duration of the pulsing.

The specified maximum current value for the IR-LED 17, 41 is 2.0 amperes for a pulse duration of 10 micro secs.

The form of the current pulse signal applied to the LED 17 is shown in FIG. *6a*.

If desired the circuit of FIG. 4 can be simplified by employing only a single transistor ZTX504 instead of the two transistors 76, 77. The following changes are then made to the circuit:

resistor 81 . . . 10 KΩ
capacitor 74 . . . 0.022 μF (RA45X)
capacitor 75 . . . 0.047 μF (YY10L)
resistor 82 . . . 220Ω

Figure 5:
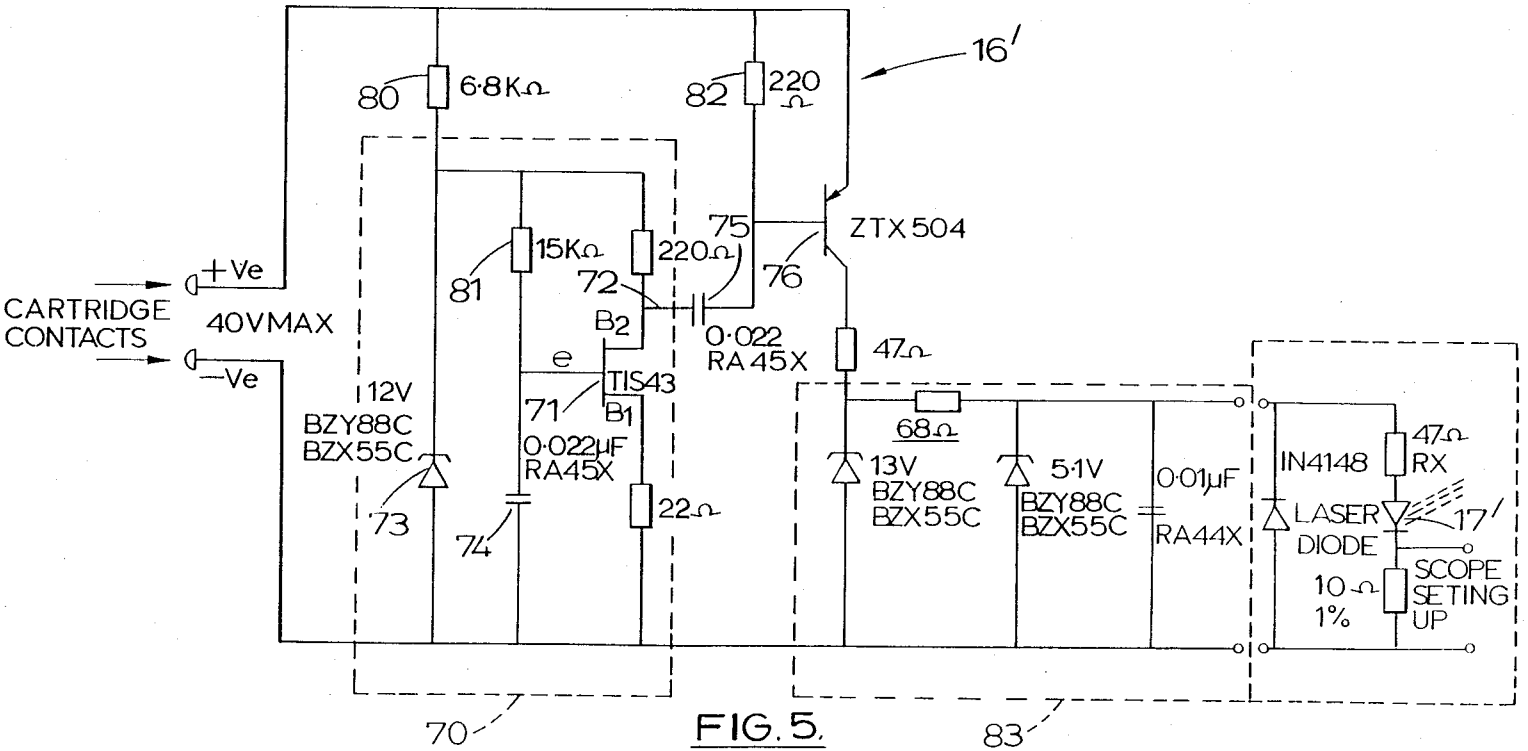
FIG. 5 is a circuit diagram of a modified pulse circuit for use with a laser diode.
Figure 6A:
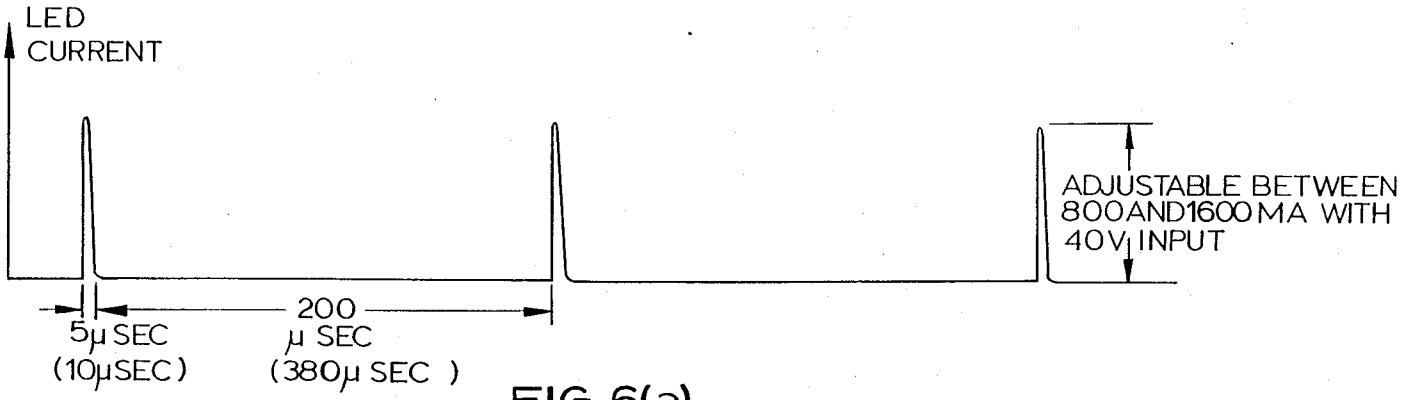
FIG. 6*a* is a trace of the light emitting diode current in the circuit of FIG. 4.
Figure 6B:
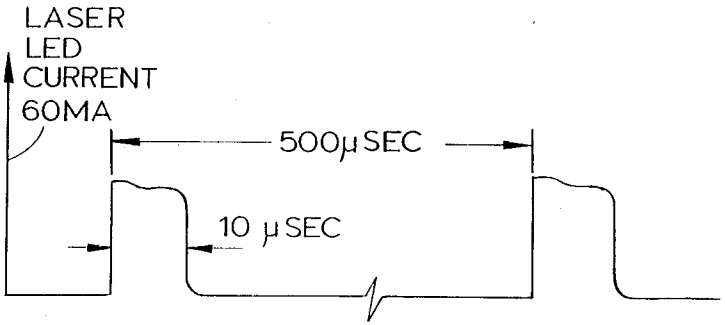
FIG. 6*b* is a trace of the laser diode current in the circuit of FIG. 5.

FIG. 5 shows a modification 16' of the energisation circuit of FIG. 4 for use with a laser diode. Circuit elements corresponding to those of FIG. 4 have been given corresponding reference numerals.

The laser diode 17' employed is a SHARP LT022MS. It is important that the pulses supplied to such a laser diode are free from high current spikes, and to this end a pulse shaping stage 83 is provided between the output of transistor 76 and the laser diode 17' which limits the maximum laser diode current to 67 mA. As shown in FIG. *6b*, the current pulses applied to the laser diode 17' are of rectangular shape. With this circuit arrangement the 67mA height of the pulses is maintained whilst the voltage of the supply capacitor falls from 40 volts to 17 volts, and only for voltages less than about 15 v does the pulse current and pulse length decline significantly.

From the foregoing description it will be appreciated that the introduction of miniaturised capacitor power sources for use in dummy cartridges or barrel units for small arms of the kind defined has enabled realistic shooting simulation which lends itself to serious training especially in the case of pistols and revolvers where only a limited number of shots can be made without reloading. However, once fully charged the cartridges will retain their stored energy level at a satisfactory value for at least twelve hours. Thereafter a small portable charging unit for the cartridges may be used.

Figure 7:
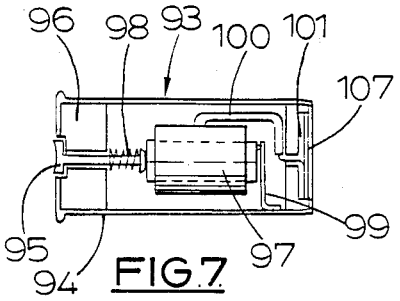
FIG. 7 is a diagrammatic longitudinal cross-section of a dummy cartridge relating to another embodiment of the invention.
Figure 8:
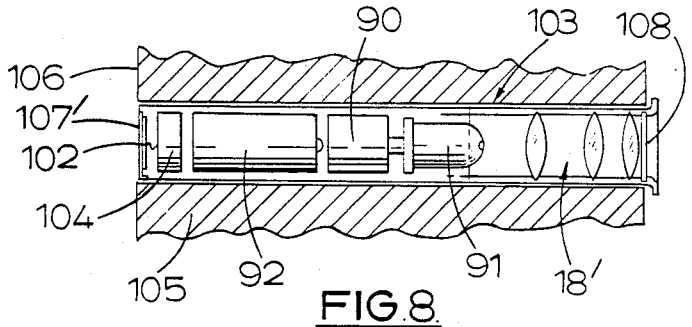
FIG. 8 is a diagrammatic longitudinal cross-section of a barrel unit including a radiation emitter and switch element for operative co-operation with the cartridge of FIG. 7.

FIGS. 7 and 8 show respectively a cartridge unit and a barrel unit according to another embodiment of the invention which work in a different manner from those of FIG. 1. In this arrangement a pulse circuit 90 connected to the infra-red emitting diode 91 is powered by a rechargeable battery unit 92, which would probably need to be a custom made unit in the case of a smaller calibre gun. Each cartridge unit 93 comprises a brass case 94 within which is mounted a piezo-electric pulse generator operated by an impact pin 95 engageable in use by the gun's firing pin. Pin 95 is slidably mounted in a polyamide block 96 and is spring-biassed against the rear face of piezoelectric crystal unit 97 by a compression spring 98, in order to ensure that no bounce takes place when the striker makes contact with the impact pin 95, thereby ensuring that a clean single pulse is produced by the piezo-electric crystal. The front end of the piezoelectric unit 97 abuts an earthed brass abutment plate 99.

A pulse of the order of 100–200 volts in amplitude is produced by the unit 97 on operation of the gun's firing mechanism and this is fed by an insulated lead 100 to an emitter plate 101 which in use closely confronts a corresponding receiver plate 102 carried by the rear end of the barrel unit 103. The capacitative linking between plates 101 and 102 which results from the close proximity of the plates conveys the pulse to an electronic unit 104 of high input impedance and low output impedance which is arranged to control switching on and off of the pulse circuit 90. The emitter plate 101 could be replaced by a pin, spaced from plate 102, which would still cooperate with the receiver plate 102 by the field effect.

It will be seen from FIG. 8 that the barrel unit 103 is located in the gun barrel 105 so that its rear end is flush with the adjacent rear end surface 106 of the barrel.

In order to protect the emitter plate 101 and receiver plate 102 they are coated with a thin layer 107, 107' of insulating material, and the lenses 18' which are acrylic are protected by a thin optical glass plate 108.

Figure 9:
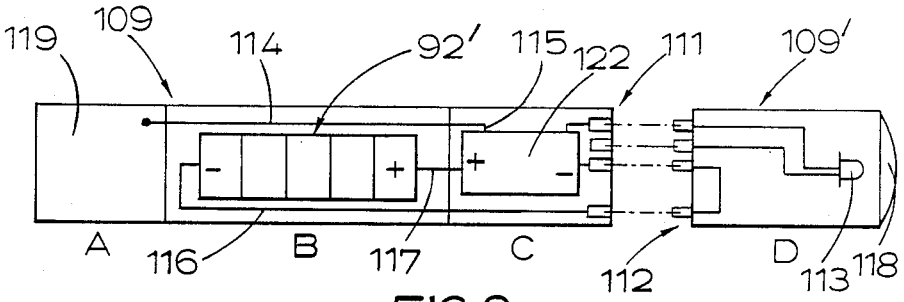
FIG. 9 is a diagrammatic illustration of a dummy cartridge for a shot gun relating to another embodiment of the invention.

FIG. 9 illustrates the arrangement of a dummy cartridge unit according to another embodiment of the invention. In this embodiment the cartridge is specially adapted for use with a shot gun and comprises two separable parts 109, 109' having an external diameter identical to those of a standard shot gun cartridge. Section 'A' at one end of the first part 109 houses a piezo-electric unit 119 producing a pulse of high voltage when the firing pin of the gun strikes the end of the unit. The impact mechanism is designed to absorb a similar amount of energy as that when the hammer of a shot gun fires a live cartridge, thus preventing overstressing and damaging the firing pin mechanism. Section 'B' of the first part contains the power source comprising a stack of Ni-Cd rechargeable battery cells 92' positioned between the piezo-electric unit 'A' and an electronics unit 'C' containing a pulse generator 122. Section 'C' terminates in a 4 pin socket 111 which in use connects with a 4 pin plug 112 on the end of a section 'D' in the second part 109' of the unit. Section 'D' houses an infrared light emitting diode (LED) 113 which is positioned behind an opaque disc (not shown) having a small aperture. The IR beam of radiation passes from the aperture through a convex lens 118 which concentrates the beam as required for a chosen range. The electrical arrangement is such that the unit is only made active when section 'D' is plugged into section 'C' and comprises an electrical conductor 114 linking the piezo-electric unit 'A' with a connection 115 on the pulse generator 122. Further conductors 116, 117 connect, respectively, the negative and positive terminals of the battery stack 92' to the pulse generator.

When the firing pin activates the piezo-electric unit 'A', the resultant electrical pulse triggers a monostable circuit controlling the running of a pulse generator in section 'C'. The duration of the resultant pulse train can be pre-set by adjustment of the monostable circuit to the desired time period. The resultant square wave output pulse from the monostable circuit activates an astable pulse generator which is designed to produce a train of square wave pulses, each pulse being 10 microsecs in duration, with an 'off' period of 990 microsecs i.e. a 1.0 millisec pulse period. The train of pulses is fed into a small power amplifier which in turn produces a train of 10 microsecs 1200 MA, peak current pulses which are fed into the IR LED 113 and so through the lens 118 to the target. The pulse generator and amplifier could be similar to that of FIG. 4.

In the case of a shot gun there is sufficient room in the barrel to accommodate all the electronic apparatus required by this invention in a single unit. It will be appreciated that in any small arm where space permits e.g. a rifle, the electronic apparatus could all be accommodated in the barrel and the dummy cartridge could accommodate a slidable pin which would merely act as an actuating member for activating a switch in the barrel unit be it a capacitor or piezoelectric device. Modifications of this kind are within the scope of this invention.

Figure 10:
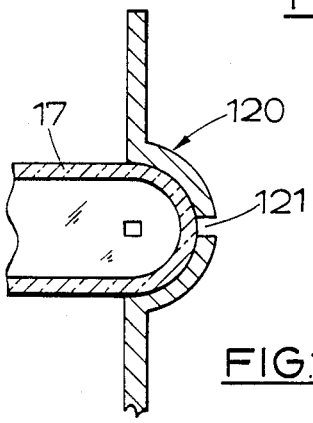
FIG. 10 is a detail showing one form of mask for concentrating the emissions from a light emitting diode.

FIG. 10 illustrates the use of a mask 120 for the glass emitter bulb 17, 91, 113 of the light emitting diode for use in any of the embodiments hereinbefore described. The mask may be produced by the steps of placing a sheet of polished metal, such as aluminium, on a flat base of malleable material such as lead and pressing a semi-spherical indentation therein by means of a ball, or ball-ended punch having a curvature equal to that of the LED bulb. The centre of the semi-spherical bowl is then provided with a hole 121 for light emission. It has been found that the mask 120 gives an increase in emission intensity of some 20%.

Alternatively, the mask could be made of a moulded plastics and sputtered with a reflective substance such as aluminium which is subsequently polished. A suitably sized hole is provided in the centre of the moulding to allow light emission.

A further possibility is to sputter aluminium directly onto the outer surface of the LED. A pinhole is then created by removal of a small region of the reflective film.

In the case of the laser diode arrangement hereinbefore described in relation to FIG. 5 a very small aperture is used and the aim is to produce, as near as possible, a parallel beam although some optical corrective means will be required.

It will be appreciated that the apparatus of this invention also lends itself for use with replica guns, or toy guns, for the purpose of practising shooting or playing shooting games.

We claim:

1. Apparatus for converting a small arm for simulated shooting, comprising an emitter means for emitting electromagnetic radiation from the barrel of the small arm, an electrical energy source for housing within the small arm to power said emitter means, switch means responsive to the firing mechanism of the small arm to operate said emitter means, the improvement wherein said electrical energy source is a capacitor capable of storing sufficient electrical energy for powering said emitter means for a predetermined useful time period, said apparatus being devoid of a battery carrier for carrying a capacitor-charging battery by the small arm during firing of the small arm, whereby said capacitor is pre-chargeable from a battery not carried by the small arm.

2. Apparatus as in claim 1 comprising a dummy cartridge comprising a dummy cartridge case, said dummy cartridge case having external dimensions commensurate with the external dimensions of a standard cartridge appropriate to said small arm, whereby said dummy cartridge is loadable into said small arm, said capacitor being housed within said dummy cartridge case.

3. Apparatus as in claim 2 comprising a barrel unit having external dimensions commensurate with the bore of said barrel for fitting within said barrel, and means for securing said barrel unit within said barrel, said barrel unit housing said emitter means, and said apparatus further comprising electrical connection means for connecting said capacitor to said barrel unit for providing electrical power to said emitter means.

4. Apparatus as in claim 3, wherein said electrical connection means and said switch means are both constituted by a first electrical contact means axially movably housed within said cartridge casing, and by a second electrical contact means on said barrel unit for engagement by said first electrical contact means when said first electrical contact means is projected toward said barrel unit, said dummy cartridge comprising resilient means biasing said first electrical contact means axially away from second electrical contact means, and projection means for projecting said first electrical contact means into electrical contact with said second electrical contact means on operation of said firing mechanism, said dummy cartridge casing having an aperture at its rear end, and said projection means comprising a firing pin engageable pad located in said aperture for receiving an impact from said firing mechanism.

5. Apparatus as in claim 4 wherein said first electrical contact means comprises co-axial contact members, and said second electrical contact means comprises complementary co-axial contact members for sliding engagement respectively with respective ones of said co-axial contact members when said co-axial contact members are projected by said projection means.

6. Apparatus as in claim 5 wherein said emitter means comprises a pulse generator for producing pulses of electromagnetic radiation, and running of said pulse generator is controlled solely by said switch means, whereby the time of engagement of said first electrical contact means with said second electrical contact means determines the time for which pulses are generated by said emitter means.

7. Apparatus as in claim 5 wherein said complementary co-axial contact members comprises first and second contact members, said first contact member comprises at least one resilient contact element which is biased radially outwards from a conductive core member, and said second contact member comprises at least one resilient contact element which is biassed radially inwards and depends from a conductive base member, said first and said second contact members making contact with inner and outer faces respectively of said co-axial, tubular contact elements when said first electrical contact means is projected into said second electrical contact means.

8. Apparatus as in claim 7, wherein said first contact member comprises a plurality of elongate, resilient contact elements supported at each end by said core member whereby an intermediate portion of each element is spaced radially outwards from said core member, and said second resilient contact member comprises a plurality of inwardly curved fingers depending from said base member.

9. Apparatus an in any of claims 4 to 8 wherein said capacitor itself carries said first electrical contact means at one end thereof, said capacitor being axially movable within said dummy cartridge casing and carrying said firing pin engageable pad at the other end thereof.

10. Apparatus for converting a small arm for simulated shooting, the small arm comprising a barrel and a firing mechanism, the apparatus comprising a pulse emitter means for housing within the small arm to emit a plurality of pulses of electromagnetic radiation from the barrel in response to an operation of the firing mechanism, firing mechanism impact means to absorb the blow of the firing mechanism and to initiate operation of the emitter means, and a pre-charged capacitor housed within the small arm for providing the sole power supply to said emitter means for generating said plurality of pulses.

11. Apparatus for converting a conventional small arm for simulated shooting, the small arm comprising a cartridge chamber, a firing mechanism and a barrel, the apparatus comprising a dummy cartridge of external dimensions to be received within said cartridge chamber, and a barrel unit of external dimensions to be received within said barrel, said barrel unit comprising an emitter of electromagnetic radiation for providing an emission of radiation from said barrel on firing of the small arm, one of said dummy cartridge and barrel unit housing an electrical energy source for powering said emitter, said dummy cartridge having a rear end for positioning adjacent to said firing mechanism and a front end for positioning adjacent to said barrel unit, said barrel unit having a rear end for positioning adjacent to said cartridge front end, and a front end for pointing outwardly of the barrel, said front end of said dummy cartridge and said rear end of said barrel unit being provided with normally spaced-apart communication means for relaying a firing signal from the firing mechanism to said barrel unit for operating said emitter.

12. Apparatus for converting a conventional small arm for simulated shooting, the apparatus comprising an emitter of electromagnetic radiation for housing within the small arm to emit radiation from the barrel of the gun, and an electrical energy source for powering the emitter, the electrical energy source comprising a pre-charged capacitor, and said emitter comprising a laser diode, said capacitor carrying a charge which is sufficient to power said emitter for a predetermined useful time.

13. A dummy cartridge assembly for fitting within the barrel of a shot gun for converting the shot gun for simulated shooting, said dummy cartridge assembly having a front end and a rear end, said assembly comprising a radiation emitter at said front end and a switch at said rear end, said switch being operable by the conventional firing mechanism of the gun, a battery holding means positioned intermediate said switch and said radiation emitter, a pulse generator positioned intermediate said battery holding means and said switch for providing pulses to said radiation emitter, two power supply connections on said pulse generator, two power supply leads respectively connecting said power supply connections to said battery holding means, two pulse output connections on said pulse generator connected to said radiation emitter, and a switch control connection on said pulse generator connected to said switch, whereby when said switch is operated by the firing mechanism said pulse generator is operated to cause radiation pulses to be emitted from the gun barrel, said dummy cartridge assembly comprising first and second separable units, a plug and socket connection means for connecting said units together, said first unit defining said front end provided with said radiation emitter, and said second unit defining said rear end provided with said switch, said plug and socket connection means comprising co-operating plug and socket elements connected in series with one of said power supply leads whereby said power supply connections to said pulse generator are both energised only when said first and second units are connected together by said plug and socket means.

* * * * *

UNITED STATES PATENT AND TRADEMARK OFFICE

CERTIFICATE OF CORRECTION

PATENT : 4,830,617

DATED : May 16, 1989

INVENTOR(S) : Roger J. Hancox and Cecil H. Banks

It is certified that error appears in the above-identified patent and that said Letters Patent is hereby corrected as shown below:

On the title page, delete "[22] Filed: Sep. 18, 1987" and insert

--[22] PCT filed: Jan. 13, 1987

[86] PCT No.: PCT/GB87/00011

§ 371 Date: Sept. 18, 1987

§ 102(e) Date: Sept. 18, 1987

[87] PCT Pub. No.: WO87/04512

PCT Pub. Date: July 30, 1987

[30] Foreign Application Priority Data

Jan. 18, 1986 [GB] United Kingdom.....8601197
June 18, 1986 [GB] United Kingdom.....8614788--.

Signed and Sealed this

Twenty-seventh Day of September, 1994

*Attest:*

Bruce Lehman

BRUCE LEHMAN

*Attesting Officer*

*Commissioner of Patents and Trademarks*